US006012477A

United States Patent [19]

Hagiwara et al.

[11] Patent Number: 6,012,477

[45] Date of Patent: Jan. 11, 2000

[54] CIRCULATING DRAINAGE SYSTEM FOR SEWAGE PIPE INSTALLATION WORK

[75] Inventors: Hideo Hagiwara; Sadamasa Kodaira, both of Tokyo, Japan

[73] Assignee: Komatsu Ltd., Tokyo, Japan

[21] Appl. No.: 09/029,610

[22] PCT Filed: Sep. 26, 1996

[86] PCT No.: PCT/JP96/02786

§ 371 Date: Mar. 11, 1998

§ 102(e) Date: Mar. 11, 1998

[87] PCT Pub. No.: WO97/12097

PCT Pub. Date: Apr. 3, 1997

[30] Foreign Application Priority Data

| | | | |
|---|---|---|---|
| Sep. 27, 1995 | [JP] | Japan | P7-249136 |
| Aug. 20, 1996 | [JP] | Japan | P8-218284 |

[51] Int. Cl.[7] ..... E03F 9/00

[52] U.S. Cl. ..... 137/205; 137/315; 137/398; 137/624.13; 137/487.5; 137/565.33; 138/93

[58] Field of Search ..... 137/205, 315, 137/398, 487.5, 624.11, 624.13, 565.23, 565.33; 138/93

[56] References Cited

U.S. PATENT DOCUMENTS

| | | | |
|---|---|---|---|
| 3,788,338 | 1/1974 | Burns | 137/205 X |
| 4,285,359 | 8/1981 | Doherty | 137/205 |
| 4,314,577 | 2/1982 | Brister | 138/93 X |
| 4,351,349 | 9/1982 | Minotti | 138/93 X |
| 4,417,598 | 11/1983 | DePirro | 138/93 X |
| 4,535,800 | 8/1985 | Leech | 137/205 |
| 4,663,056 | 5/1987 | Leech | 137/205 X |
| 4,691,731 | 9/1987 | Grooms et al. | 137/205 |
| 5,069,243 | 12/1991 | Foreman | 137/205 |
| 5,462,077 | 10/1995 | Cohen et al. | 138/93 X |
| 5,575,304 | 11/1996 | Hassett | 137/205 X |
| 5,615,701 | 4/1997 | Yamabe et al. | 137/225 |

FOREIGN PATENT DOCUMENTS

| | | |
|---|---|---|
| 5-179690 | 7/1993 | Japan . |
| 6-13890 | 4/1994 | Japan . |
| 6-23832 | 6/1994 | Japan . |
| 7-2774 | 1/1995 | Japan . |

*Primary Examiner*—John Rivell
*Attorney, Agent, or Firm*—Nikaido, Marmelstein, Murray & Oram LLP

[57] ABSTRACT

A sewage by-pass discharging apparatus for sewage pipe works comprises an upstream side stop cock disposed at an upstream side of a sewage pipe laid in a working area, a downstream side stop cock disposed at a downstream side of the sewage pipe laid in the working area, a member for discharging the sewage accumulated at an upstream side from the upstream side stop cock to a downstream side from the downstream sides stop cock by bypassing the sewage pipe, a drain pipe connected to the sewage pipe laid in the working area, a drain pit connected to the drain pipe, a stop cock for preventing the sewage from flowing from the drain pit into the drain pipe, and a unit discharging the sewage reserved in the drain pit to downstream side from the downstream side stop cock. According to this structure, the working to the sewage pipe can be performed while the sewage system is maintained in a state of being utilized as usual by the residents of the respective homes.

13 Claims, 14 Drawing Sheets

CIRCULATING DRAINAGE SYSTEM FOR SEWAGE PIPE INSTALLATION WORK

TECHNICAL FIELD

The present invention relates to a sewage by-pass discharging apparatus for working a sewage pipe laid under the ground, the apparatus enabling to prevent the sewage from flowing into a working area including the sewage pipe when the sewage pipe is subjected to various workings such as cleaning, inspection, repairing, replacement or the like.

BACKGROUND ART

In general, when a sewage pipe laid under the ground is used for a long period of time, soil sediment, sludge, foreign material are deposited at interior of the sewage pipe, so that it is necessary to remove the deposited sediment, sludge and foreign material and clean the sewage pipe.

Further, the sewage pipe laid under the ground will be deteriorated with elapse of times, so that cracks and defects at joint portions of the sewage pipes are liable to occur. In particular, in a case where the sewage pipe is a Hume pipe, a bore or hole is liable to be formed due to erosion of the pipe body. Therefore, the interior of the sewage pipe is required to be periodically inspected and repaired, or the sewage pipe per se is required to be replaced by new one.

As described above, when the sewage pipe is subjected to various workings such as cleaning, inspection, repairing, replacement or the like, various equipments and instruments for the workings are conveyed into the sewage pipe, and workers would access into the sewage pipe to perform the working. Therefore, it is obliged for the sewage system containing the objective sewage pipe to be stopped in use.

As a countermeasure for solving the afore-mentioned problems, for example, a sewage by-pass or circulation discharging apparatus for sewage pipe works is well known as disclosed in Japanese Utility Model Publication No. HEI 6-13890.

The conventional sewage by-pass discharging apparatus for working the sewage pipe, as shown in FIG. 15, has a structure in which a portion 1*a* between a first manhole 2 and a second manhole 3 of the sewage pipe 1 is specifically provided as the working area, and a stop cock 4 is respectively provided to both an upstream side portion 1*b* and a downstream side portion 1*c* of the sewage pipe 1 laid in the working area 1*a* thereby to prevent the sewage or the like from flowing into the sewage pipe 1*a* laid in the working area la.

Further, a suction pipe 6 of a pump 5 disposed on the ground is connected to the upstream side portion 1*b*, while a delivery pipe 7 of the pump 5 is connected to the downstream side portion 1*c*, whereby the sewage or the like accumulated at upstream side from the working area flows toward the downstream side through bypassing the working area.

According to the sewage by-pass discharging apparatus for working the sewage pipe as described above, even if the sewage system is utilized as usual, the sewage would not flow into the sewage pipe laid in the working area. Therefore, the workings such as cleaning, inspection, repairing, replacement or the like for the sewage pipe laid in the working area can be performed while the sewage system is utilized as usual.

However, in actual, a plurality of drain pipes are connected to the sewage pipe laid between the first manhole 2 and the second manhole 3, and the drain pipes are connected to drain pits provided at respective homes of residents, so that the sewage or the like discharged from a plurality of the homes would flow into the sewage pipe laid in the working area.

Due to this situation, the respective residents of which the drain pit is connected to the sewage pipe laid in the working area are obliged to stop utilizing the sewage system during the working for the sewage pipe.

Therefore, an object of the present invention is to provide a sewage by-pass discharging apparatus for sewage pipe works capable of achieving various workings such as cleaning, inspection, repairing, replacement or the like for the sewage pipe while being maintained in a state where the respective residents can utilize the sewage system as usual.

DISCLOSURE OF THE INVENTION

In order to achieve the afore-mentioned object, according to one aspect of the present invention, there is provided a sewage by-pass discharging apparatus for sewage pipe works, comprising: an upstream side stop cock provided at an upstream side of a sewage pipe laid in a working area; a downstream side stop cock provided at a downstream side of the sewage pipe laid in the working area; means for discharging the sewage accumulated at an upstream side from the upstream side stop cock into a downstream side from downstream side stop cock by bypassing the sewage pipe; a drain pipe connected to the sewage pipe laid in the working area; a drain pit connected to the drain pipe; a stop cock for preventing the sewage from flowing from the drain pit into the drain pipe; and means for discharging the sewage reserved in the drain pit into the downstream side from the downstream side stop cock.

In the above structure, the apparatus may preferably have a structure in which both the upstream side and the downstream side stop cocks expansively deform by being supplied with air so that an outer periphery portion of each stop cock is press contacted to an inner periphery surface of the sewage pipe, and each of the stop cocks is provided with a pipe so as to penetrate through the stop cock.

The apparatus may preferably have a structure in which each of the plural drain pits is provided with an auxiliary suction pipe so as to be inserted into the drain pit respectively, each of the auxiliary suction pipes is connected to a main suction pipe which is connected to a suction side of a suction discharging equipment, so that the sewage in the respective drain pits is discharged into the downstream side from the downstream side stop cock.

Further, the apparatus may preferably have a structure in which each of the plural drain pits is provided with an auxiliary suction pipe so as to be inserted into the drain pit respectively, each of the auxiliary suction pipes is connected to a suction side of a suction discharging equipment, so that the sewage in the respective drain pits is discharged into a downstream side from the downstream side stop cock.

It is more preferable that the apparatus further comprises means for controlling the respective auxiliary suction pipes so as not to simultaneously suck the sewage.

In the above structure, it may be preferred for the apparatus to have a structure in which each of the auxiliary suction pipes is provided with a shut-off valve, the shut-off valves taking an opened position in turn at predetermined intervals of time whereby each of the auxiliary suction pipes sucks the sewage in turn for a predetermined time.

Further, the apparatus may preferably have a structure in which each of the drain pits is provided with a level sensor for sensing a level of the sewage so as to output a signal when the level reaches to a predetermined level, and the shut-off valve provided to the auxiliary suction pipe inserted into the corresponding drain pit having the level sensor preferentially takes an opened position when the level sensor outputs the signal.

Furthermore, the apparatus may preferably have a structure in which the auxiliary suction pipe is provided with a float valve which takes an opened position when the level of the sewage in the drain pit becomes higher than a predetermined level while takes a closed position when the level of the sewage in the drain pit becomes lower than a predetermined level.

In the above structure in another aspect of this invention, there is provided a sewage by-pass discharging apparatus for sewage pipe works, comprising: a shut-off valve provided to each of the auxiliary suction pipes, respectively; a controller for controlling the respective shut-off valves so as to flake an opened or closed position; and a sensor for sensing a degree of vacuum of a portion closer to a drain pit from the shut-off valve so as to input the degree of vacuum to the controller, wherein the controller controls the shut-off valves in such a manner that one shut-off valve is opened while remaining shut-off valves are closed so as to discharge the sewage in one drain pit through one auxiliary suction pipe, and when the degree of vacuum of the one auxiliary suction pipe becomes lower than a setting value, the one shut-off valve is closed while one of the other remaining shut-off valves is opened in a predetermined order.

In still another aspect of the present invention, there is provided a sewage by-pass discharging apparatus for sewage pipe works, comprising: a shut-off valve provided to each of the auxiliary suction pipes, respectively; a controller for controlling the respective shut-off valves so as to take an opened or closed position; and a sensor for measuring a degree of vacuum of a portion between the respective drain pit and the suction discharging equipment so as to input the degree of vacuum to the controller, wherein the controller controls; the shut-off valves in such a manner that one shut-off valve is opened while the remaining shut-off valves are closed so as to discharge the sewage in one drain pit through one auxiliary suction pipe, and when the degree of vacuum detected by the sensor becomes lower than a setting value, the one shut-off valve is closed while one of the other remaining shut-off valves is opened in a predetermined order.

Furthermore, the apparatus may preferably have a structure in which the controller controls the shut-off valves in such a manner that one shut-off valve is opened while the remaining shut-off valves are closed so as to discharge the sewage in one drain pit through one auxiliary suction pipe, and when the degree of vacuum detected by the sensor becomes lower than a setting value, the one shut-off valve is closed, and when the degree of vacuum detected by the sensor is returned to the setting value, one of the other remaining shut-off valves is opened.

In still another aspect of the present invention, there is provided a sewage by-pass discharging apparatus for sewage pipe works, comprising: a shut-off valve provided to each of the auxiliary suction pipes, respectively; a controller or controlling the respective shut-off valves so as to take an opened or closed position; a sensor for measuring a degree of vacuum of a portion between a suction opening of the respective auxiliary suction pipes provided to the drain pits and the suction discharging equipment; and a level sensor for sensing a level of the sewage in the drain pit to input a signal into the controller when the level reaches to a predetermined level, wherein the controller controls the shut-off valves in such a manner that when the signal from the level sensor is not inputted, one shut-off valve is opened in a predetermined order while the remaining shut-off valves are closed so as to discharge the sewage in one drain pit through one auxiliary section pipe, and when the degree of vacuum detected by the sensor becomes lower than a setting value, the one shut-off valve is closed while one of the other remaining shut-off valves is opened in a predetermined order and wherein the controller controls the shut-off valves in such a manner that when the signal from the level sensor is inputted, the shut-off valve in an opened state at the time is closed while the shut-off valve provided to the auxiliary suction pipe connected to the drain pit having the level sensor is opened, and when the degree of vacuum detected by the sensor becomes lower than a setting value, the one shut-off valve is closed while one of the other remaining shut-off valves is opened in a predetermined order.

In still another aspect of the present invention, there is provided a sewage by-pass discharging apparatus for sewage pipe works, comprising: a shut-off valve provided to each of the auxiliary suction pipes, respectively; a controller for controlling the respective shut-off valves so as to take an opened or closed position; a sensor for measuring a degree of vacuum of a portion between of the respective shut-off valves and the suction discharging equipment; and a level sensor for measuring a level of the sewage in the drain pit to input a signal into the controller when the level reaches to a predetermined level, wherein the controller has:

a first function of controlling the shut-off valves in such a manner that when the degree of vacuum measured by the sensor becomes lower than a predetermined value, the one shut-off valve is closed while one of the other remaining shut-off valves is opened in a predetermined order;

a second function of controlling the shut-off valves in such a manner that when a sucking time exceeds a predetermined time in a while the degree of vacuum would not become lower than a predetermined value, the one shut-off valve is closed while one of the other remaining shut-off valves is opened in a predetermined order; and a third function of preferentially controlling the shut-off valves regardless the first and second functions in such a manner that when the signal from the level sensor is inputted into the controller, the shut-off valve in an opened state at this time is closed while the shut-off valve provided to the auxiliary suction pipe connected to the drain pit having the level sensor is opened, and when the degree of vacuum detected by the sensor becomes lower than a setting value, or when a sucking time exceeds a predetermined time in a while the degree of vacuum would not become lower than a setting value, the one shut-off valve is closed while one of the other remaining shut-off valves is opened in turn.

Advantages of the sewage by-pass discharging apparatus for sewage pipe works having such structures according to the present invention are as follows.

According to the present invention, the stop cock is provided to both the upstream and downstream side portions of the sewage pipe laid in the working area, respectively, so that the sewage or the like flowing in the sewage pipe would not flow into the sewage pipe laid in the working area. Further, there is provided with the stop cock for preventing the sewage from flowing out of the drain pit of the respective homes to the drain pipe, so that the sewage or thus like flowing from the drain pit of the respective homes would not flow into the sewage pipe laid in the working area. In addition, the sewage or the like accumulated at the upstream side of the sewage pipe laid in the working area is discharged into the downstream side by bypassing the working area, and the sewage or the like accumulated in the drain pits of the respective homes is discharged into the downstream side from the sewage pipe laid in the working area.

As a result, the workings such as cleaning, inspection, repairing, replacement or the like for the sewage pipe can be performed while the sewage system is in a state of being utilized as usual by the residents of the respective homes.

In addition, the bodies of both the upstream side and the downstream side stop cocks are press contacted to inner periphery surfaces of the sewage pipes, excellent sewage-sealing property can be obtained, and the sewage or the like can be sucked or discharged by using the pipe penetrating through the up-stream side and the downstream side stop cocks.

Further, a length of the auxiliary suction pipe to be inserted into the respective drain pits can be shortened, and only one elongated main suction pipe can be disposed in a corner portion of a road, so that those suction pipes would not obstruct passengers walking on the road or the working area.

Furthermore, an initial setup for the working can be finished only by connecting the respective suction pipes to a suction side of the suction discharging equipment, so that the working can be simplified.

In addition, each of the auxiliary pipes is constructed so as not to simultaneously suck the sewage or the like, so that a capacity of the suction discharging equipment can be reduced, whereby a small-sized suction discharging equipment is available.

Furthermore, only one of the respective auxiliary pipes performs the sucking operation in turn for a predetermined time, so that a capacity of the suction discharging equipment can be further reduced, whereby a suction discharging equipment having a smaller size is be available.

In addition, in a case where the discharging amounts of the sewage from the respective homes are greatly varied, the sewage contained in a drain pit dealing with the large discharging amount of the sewage is preferentially sucked, so that there is no fear of the sewage filling up and overflowing the drain pit.

Further, in order to control the sewage level, it is sufficient to provide a float valve, so that the structure of the apparatus can be simplified, and a complicated control is not necessary.

In addition, according to the present invention, when the sewage in one drain pit is discharged through one auxiliary suction pipe and the sewage amount in the drain pit is decreased whereby the auxiliary suction pipe sucks air, a degree of vacuum measured by the sensor becomes lowered whereby the shut-off valve provided to the auxiliary suction pipe is closed while one of the other remaining shut-off valves is opened in a predetermined order, so that the sewage in one of the remaining drain pits is discharged.

As a result, the sewages in a plurality of the drain pits can be discharged at every drain pit, so that the suction discharging equipment can be Constructed in a small size. Further, the auxiliary suction pipe is provided with the shut-off valve and the sensor, so that it is sufficient to connect the auxiliary suction pipe to the drain pit, thus simplifying the operation thereof.

Further, the sensor is provided to the auxiliary suction pipe at a portion close to the drain pit and apart from the shut-off valve, so that when the shut-off valve is closed, the degree of vacuum measured by the sensor will become to an atmospheric pressure (760 mmHg), whereby the sensor would not malfunction.

In addition, a distance from the sensor to the drain pit is short while a distance from the sensor to the suction discharging equipment is long. Therefore, when the amount of the sewage in the drain pit is decreased and the auxiliary suction pipe sucks air whereby a value measured by the sensor becomes lower than a setting value, the sewage exists at a portion of the auxiliary suction pipe close to the suction discharging equipment, so that the degree of vacuum of the suction discharging equipment would riot be lowered. In addition, when the value measured by the sensor becomes lower than a setting value, the shut-off valve is promptly closed.

As a result, there is no case of lowering the vacuum degree of the suction discharging equipment, the sewage in the respective drain pits can be effectively discharged.

Further, in the present invention, the sensor is provided at a portion between the respective drain pits and the suction discharging equipment, so that only one sensor can be commonly used.

In addition, according to the present invention, when the sewage in one drain pit is discharged through one auxiliary suction pipe and the auxiliary suction pipe sucks air, the shut-off valve provided to the auxiliary suction pipe is closed. Subsequently, when the degree of vacuum is returned to a predetermined value, one of the remaining shut-off valves is opened in a predetermined order, so that the sewage in one of the remaining drain pits is discharged.

Accordingly, during a time period from a time when the degree of vacuum measured by the sensor becomes lower than the setting value to a time when the degree of vacuum becomes to a predetermined value, each of the shut-off valves is in a closed state, so that the degree of vacuum is returned to the predetermined value in a short period of time.

Furthermore, according to the present invention, in a case where a signal from the level sensor is not inputted to the controller, the sewage in one drain pit is discharged through one auxiliary suction pipe in a predetermined order. While, when the amount of sewage in the drain pit is decreased and the auxiliary suction pipe sucks air, the degree of vacuum measured by the sensor becomes lower than a setting value and the shut-off valve provided to the auxiliary suction pipe is closed, while one of the other remaining shut-off valves is opened in a predetermined order whereby the sewage in one of the other remaining drain pits is discharged.

In addition, in a case where the sewage in one drain pit is discharged in a predetermined order by opening one of the shut-off valves in a predetermined order as described above, when the sewage level in one drain pit reaches to a constant level, a signal from the level sensor is inputted to the controller. In this case, the controller controls the respective shut-off valves in such a manner that the shut-off valve in an opened state at that time is closed while the shut-off valve corresponding to the level sensor is opened whereby the sewage in the drain pit having a sewage level higher than the constant value is discharged , and when the degree of vacuum measured by the sensor becomes lower than the setting value, the shut-off valve is closed and the remaining shut-off valves are opened in a predetermined order thereby to return to the opening-closing controlling operation as in the case where a signal from the level sensor is not inputted to the controller as described above.

As a result, the sewage in a plurality of the drain pits can be discharged at every drain pit in a predetermined order, so that the suction discharging equipment can be constructed in a small size. Further, when the sewage is accumulated in a drain pit so as to exceed a constant height, the sewage in the drain pit is preferentially discharged regardless of the order described above, so that there is no fear of the sewage in the drain pit overflowing.

Further, according to the present invention, in a case where the sewage in the respective drain pits is discharged in a predetermined order, the discharging operation in accordance with the degree of vacuum of the drain pit is preferentially performed. Even if the degree of vacuum is not lower than the setting value, when the sucking time exceeds a predetermined time, the shut-off valve is closed and one of the other remaining shut-off valves is opened in a predetermined order thereby to discharge the sewage in one of the other remaining drain pits.

In addition to this operation, when the signal from the level sensor is inputted to the controller, the shut-off valve in an opened state at that time is closed while the shut-off valve corresponding to the level sensor is opened, whereby the sewage in the drain pit of which sewage level exceeds the setting value is preferentially discharged.

As a result, even if the sensor fails to detect the degree of vacuum of a part of the drain pits, after the sucking operation is continued for a predetermined time, the sewage discharging operation is performed in turn from the remaining one of the drain pits to another drain pit in a predetermined order, so that the sewage can be securely discharged from all of the drain pits.

In addition to the operation described above, the sewage in the drain pit of which sewage level exceeds the constant level is preferentially discharged, so that the sewage would not overflow from the drain pit, and the sewage can be securely discharged from all of the drain pits.

BRIEF DESCRIPTION OF THE DRAWINGS

The present invention will become more apparent and more easily be understood from the following detailed description when taken in conjunction with the accompanying drawings in which preferred embodiments of the present invention are shown by way of illustrative examples.

Further, the embodiments shown in the accompanying drawings are not for specifying or limiting the scope of the present invention, but for merely making the explanation and understanding of the invention more easily.

In the accompanying drawings:

FIG. 1 is a longitudinal view showing a first embodiment of a sewage by-pass discharging apparatus for sewage pipe works according to the present invention.

FIG. 2 is an explanatory view showing a suction discharging equipment to be used in the present invention.

FIG. 3 is a cross sectional view showing an upstream side stop cock or a downstream side stop cock to be used in the present invention.

FIG. 4 is a cross sectional view showing a drain pit to be used in the present invention.

FIG. 5 is a plan view showing a first embodiment of a drainage route of the sewage in a drain pit to be used in the present invention.

FIG. 6 is a diagram of a control circuit to be used in the present invention.

FIG. 7 is a cross sectional view showing an embodiment of a drain pit in which a float valve is attached to an auxiliary suction pipe to be used in the present invention.

FIG. 8 is a plan view showing a second embodiment of a drainage route of the sewage in a drain pit to be used in the present invention.

FIG. 9 is a longitudinal view showing a second embodiment of a sewage by-pass discharging apparatus for working a sewage pipe according to the present invention.

FIG. 10 is an explanatory view showing a third embodiment of a drainage route of the sewage in a drain pit to be used in the present invention.

FIG. 11 is another embodiment of a diagram of a control circuit to be used in the present invention.

Figure 12:
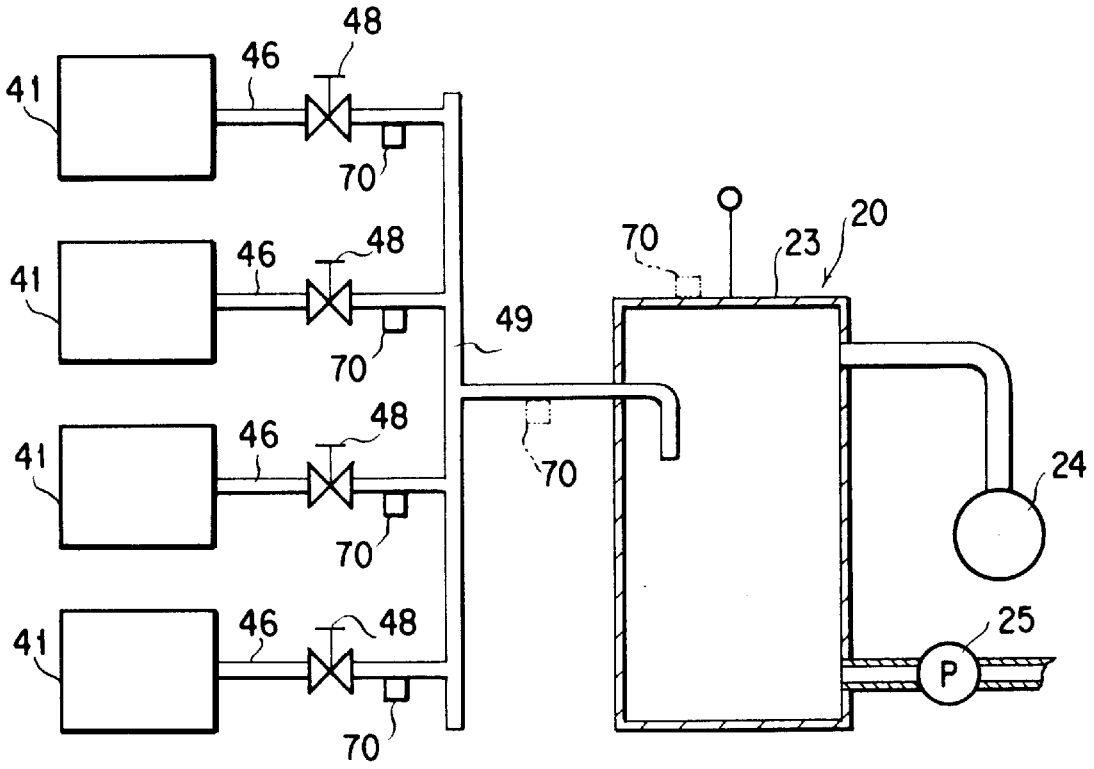

FIG. 12 is an explanatory view showing a fourth embodiment of a drainage route of the sewage in a drain pit to be used in the present invention.

Figure 13:
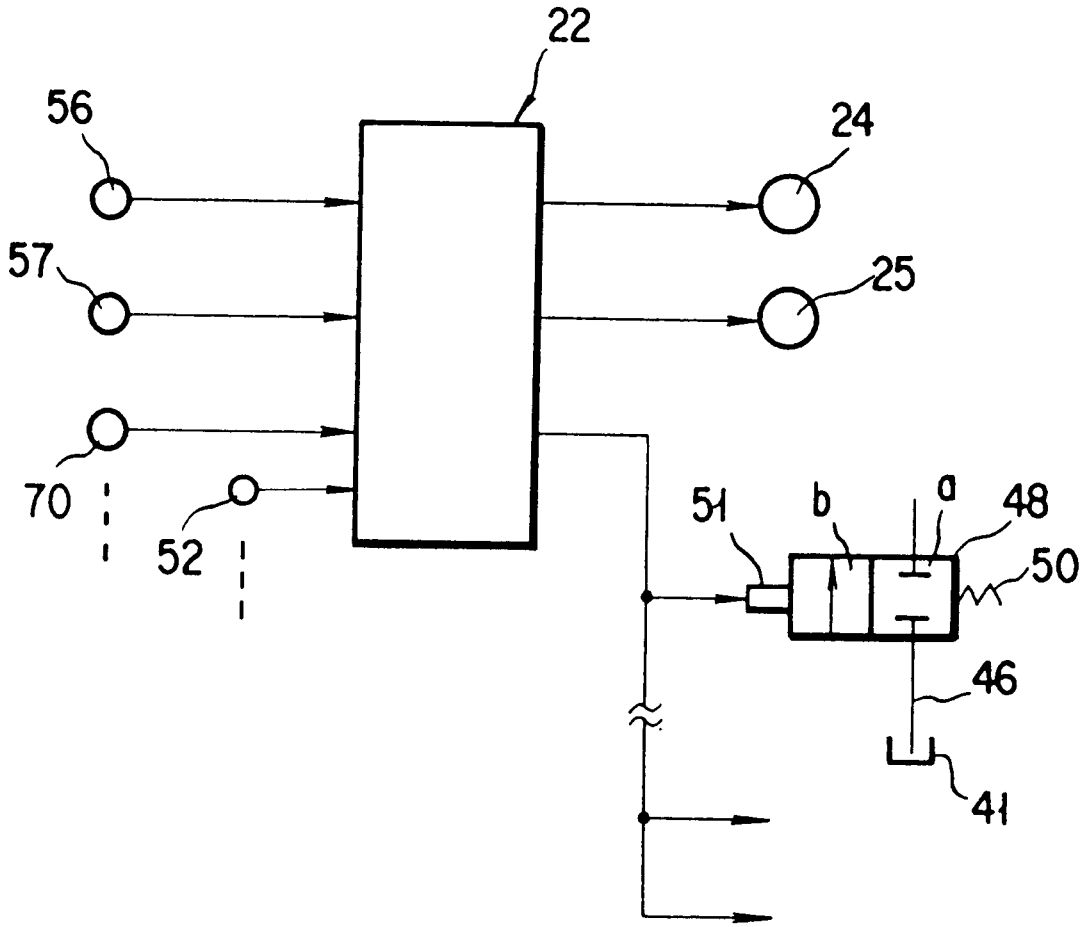

FIG. 13 is still another embodiment of a diagram of a control circuit to be used in the present invention.

Figure 14:
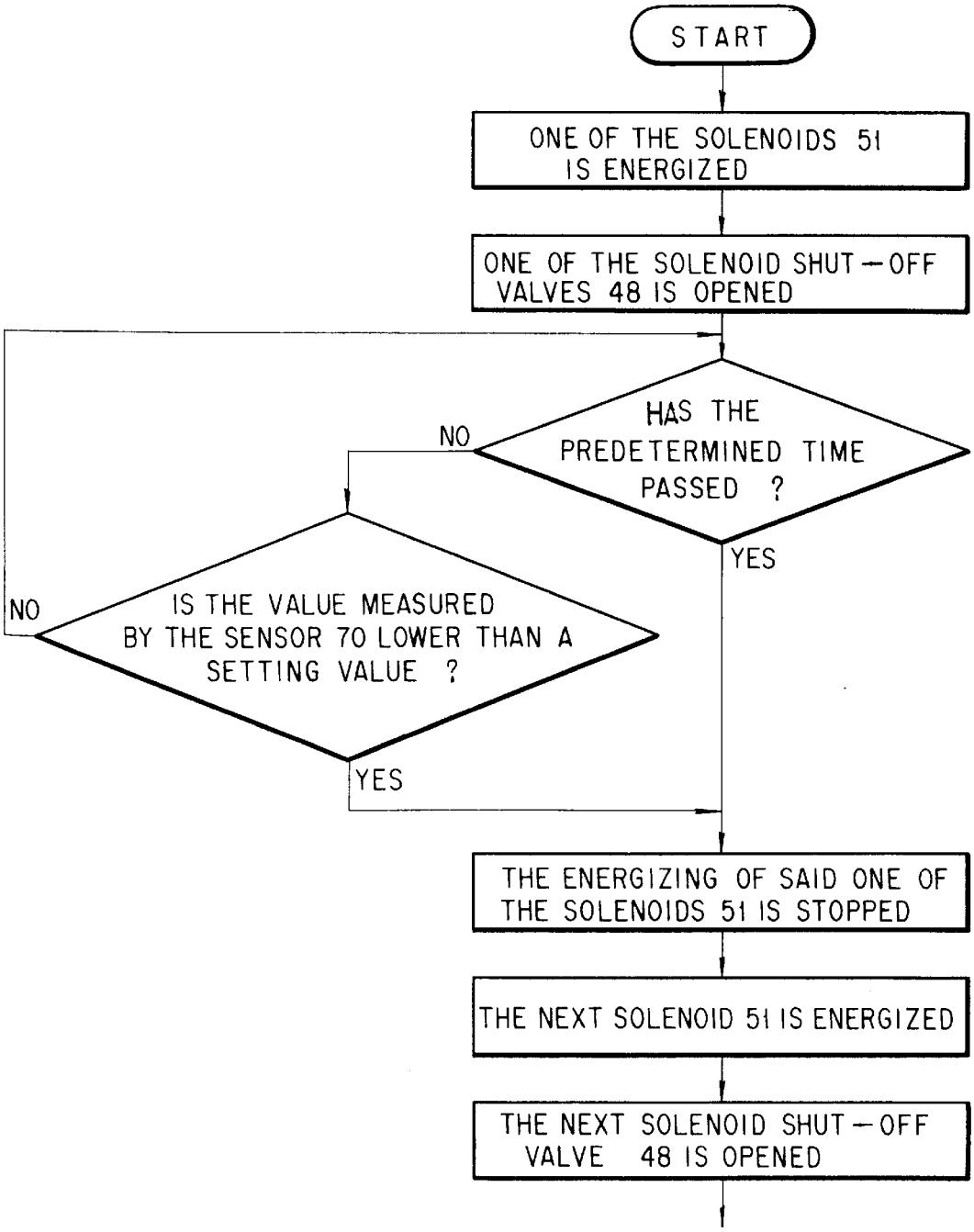

FIG. 14 is a flow-chart explaining opening and closing operations of a solenoid shut-off valve, which actuates in accordance with a time and a vacuum pressure, to be used in the apparatus according to the present invention.

Figure 15:
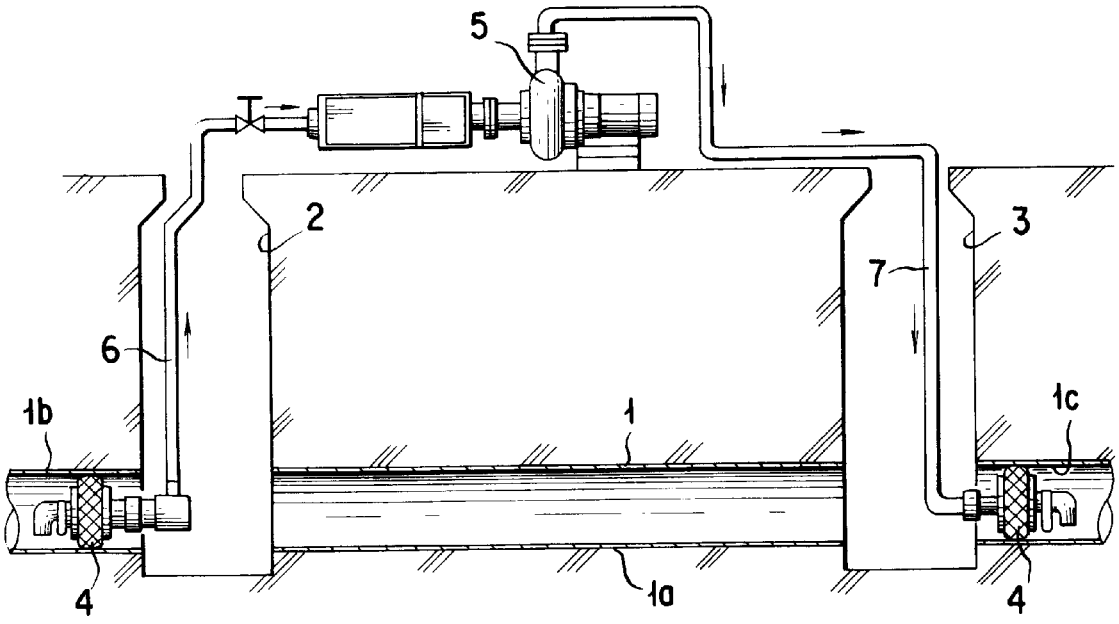
FIG. 15 PRIOR ART

FIG. 15 is a cross sectional view showing a conventional sewage discharging apparatus for working a sewage pipe.

BEST MODE FOR EMBODYING THE INVENTION

The preferred embodiments of the sewage by-pass discharging apparatus for sewage pipe works according to the present invention will be described hereunder with reference to the accompanying drawings.

Figure 1:
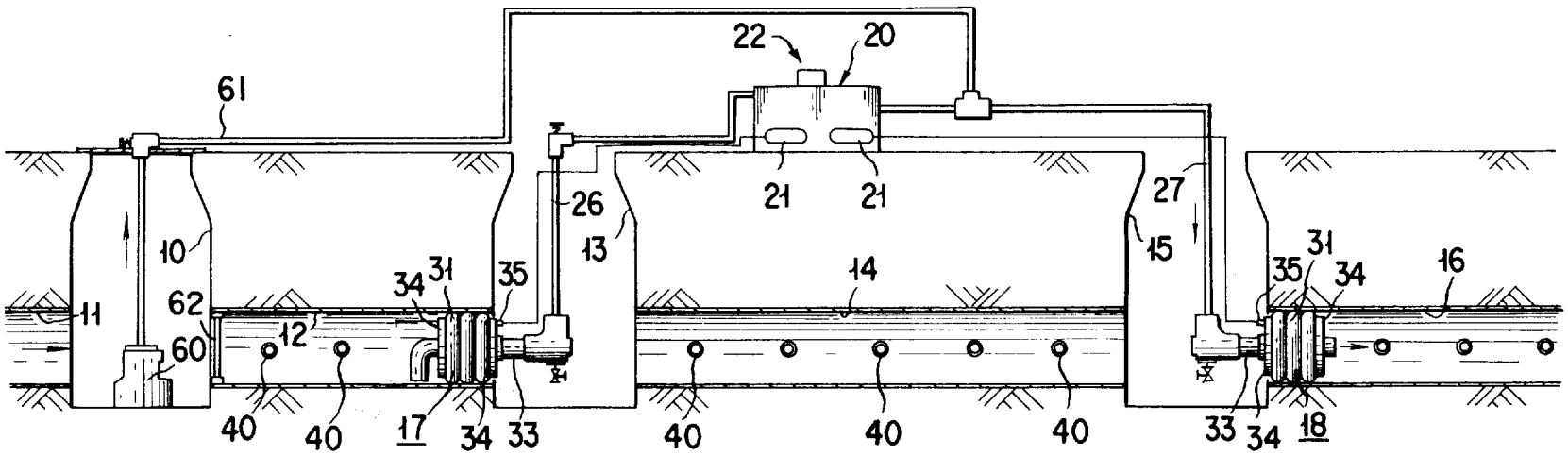

In the drawings, FIG. 1 is a view showing a first embodiment of a sewage by-pass discharging apparatus for sewage pipe works according to the present invention. In this sewage by-pass discharging apparatus for sewage pipe works, a first sewage pipe 11 is opened to a first manhole 10. A second sewage pipe 12 is opened to the first manhole 10 and also to a second manhole 13. A third sewage pipe 14 is opened to the second manhole 13 and also to a third manhole 15. A fourth sewage pipe 16 is opened to the third manhole 15. The respective sewage pipes are communicated to each other through the respective manholes and laid under the ground. The sewage or the like flows from the first sewage pipe 11 toward the fourth sewage pipe 16.

In a case where the third sewage pipe 14 is specified to be a working area, an upstream side stop cock 17 is provided to the upstream side of the third sewage pipe 14 i.e., an outlet side of the second sewage pipe 12 opened to the second manhole 13. Further, a downstream side stop cock 18 is provided to the downstream side of the third sewage pipe 14 i.e., an inlet side of the fourth sewage pipe 16 opened to the third manhole 15. Accordingly, the sewage or the like flowing from the upstream side sewage pipe would not flow into the third sewage pipe 14 as the working area.

By the way, the reason why the stop cock is not provided to both inlet and outlet sides of the third sewage pipe 14 but is provided to both the outlet side of the second sewage pipe 12 and the inlet side of the fourth sewage pipe 16, is as follows. Because, when workers carry out the working for the third sewage pipe 14, the workers are required to access into the sewage pipe through the second manhole 13 and the third manhole 15.

On the ground, there is provided with a controlling system comprising a suction discharging equipment 20, a controlled-type compressor 21 and a controller 22 or the like.

Figure 2:
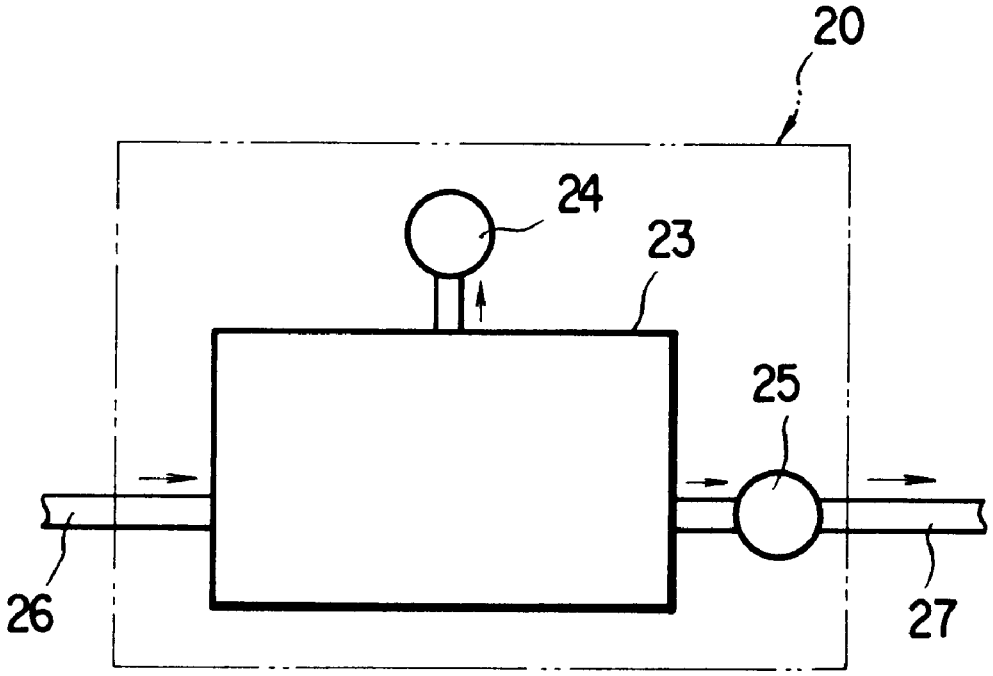

As shown in FIG. 2, the suction discharging equipment 20 comprises a tank 23, a vacuum suction pump 24 and a delivery pump 25, and the equipment 20 performs so that the vacuum suction pump 24 sucks air in the tank 23 and the sewage or the like is sucked into the tank 23 through a suction pipe 26, whereby the sewage or the like in the tank 23 is delivered to a drain pipe 27.

The controller 22 controls the control-type compressor 21, the vacuum suction pump a4, the delivery pump 25 and a solenoid shut-off valve or the like as described later on.

An inlet port of the suction pipe 26 connected to the suction discharging equipment 20 is provided at the upstream side from the upstream side stop cock 17, while an outlet port of the drain pipe 27 is provided at the downstream side from the downstream side stop cock 18. According to this structure, the sewage or the like flowing into the second sewage pipe 12 can flow into the fourth sewage pipe 16 by bypassing the third sewage pipe 14, thus operating the third sewage pipe 14 without stopping the working of the sewage system.

Figure 3:
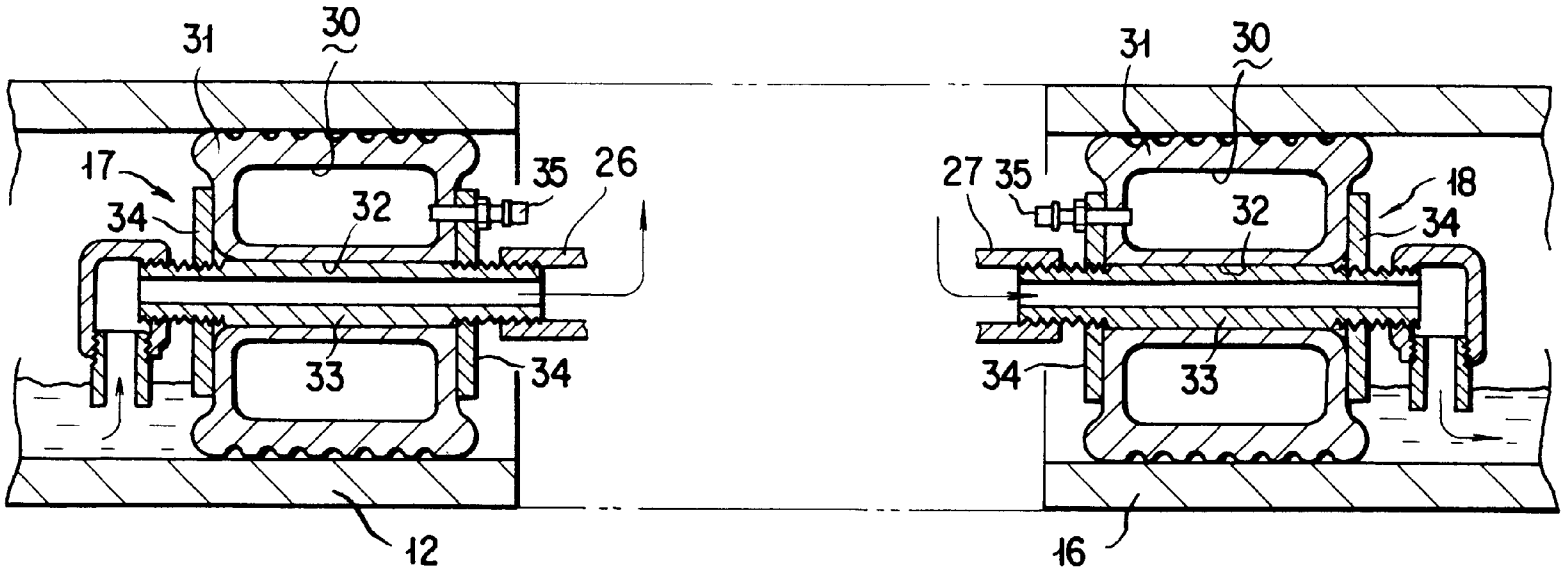

As shown in FIG. 3, each of the upstream side stop cock 17 and the downstream side stop cock 18 comprises a ring-shaped body 31 having a hollow portion composed of flexible materials such as rubber or the like, a pipe 33 inserted into a central penetration bore 32 formed to the body 31, a pair of press plates 34 contacted to the body 31 by being screwed with both end portions of the pipe 33 in a longitudinal direction, and a nozzle 35 attached to one of the paired press plates 34, the nozzle 35 being connected to the compressor 21 described above.

According to the structure described above, when the compressor 21 is started and air is supplied to the hollow portion 30 of the body 31 through the nozzle 35, the body 31 is expansively deformed so that an outer periphery portion of the body 31 is press contacted to an inner periphery surface of the sewage pipe. As a result, an excellent sewage sealing property can be achieved.

In addition, the suction pipe 26 is connected to the pipe 33 of the upstream side stop cock 17, while the drain pipe 27 is connected to the pipe 33 of the downstream side stop cock 18.

Figure 4:
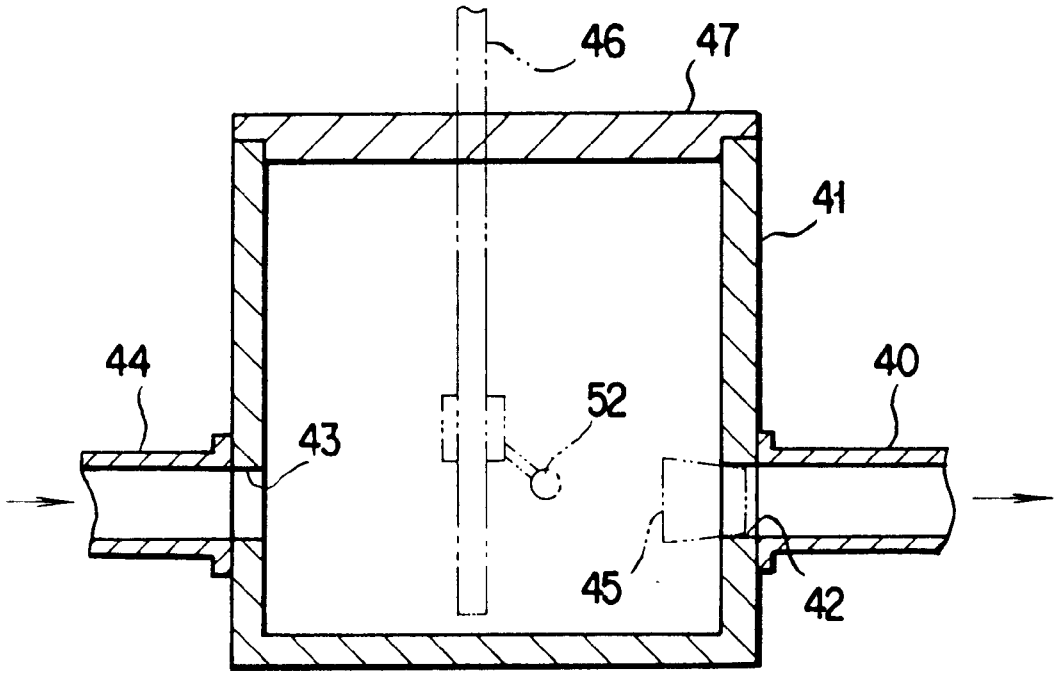

A plurality of drain pipes 40 Ere connected to the third sewage pipe 14. As shown in FIG. 4, each of the drain pipes 40 is connected to outlets 42 of the drain pits 41 for the respective homes. A discharging pipe 44 connected to a kitchen, a toilet, a bath room or the like is connected to an inlet 43 of the drain pit 41. According to this structure, the sewage discharged from the respective homes flows into the third sewage pipe 14 through the drain pipe 40.

When a working for the third sewage pipe 14 is carried out, as indicated in FIG. 4 by a virtual line, a stop cock 45 is provided to the outlet 42 of the drain pit 41 thereby to prevent the sewage or the like from flowing into the drain pipe 40. Further, the sewage or the like flowing into the drain pit 41 is discharged through the auxiliary suction pipe 46 by inserting the auxiliary suction pipe 46 into the drain pit 41.

In a case where the stop cock 45 is provided or a case where the auxiliary suction pipe 46 is inserted into the drain pit 41, a cover 47 is removed.

Figure 5:
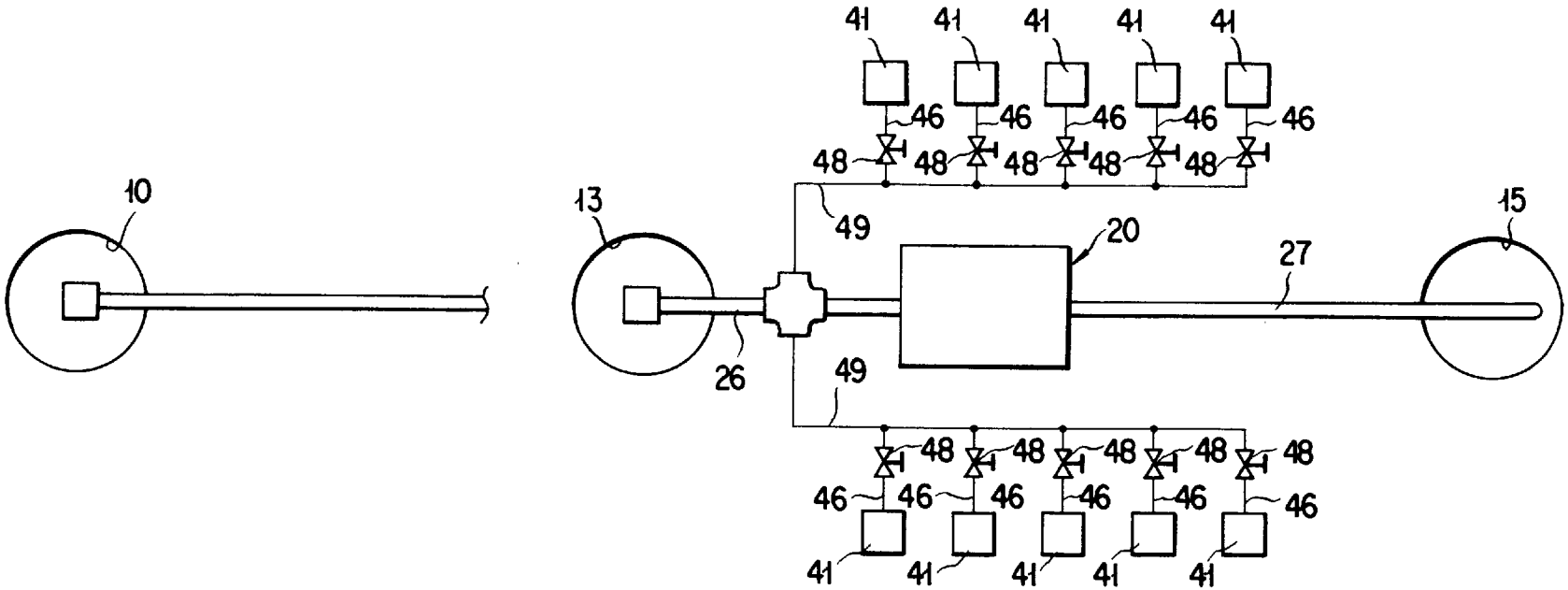

As shown in FIG. 5, each of the auxiliary suction pipes 46 is connected to one main suction pipe 49 through the shut-off valve 48, for example, a solenoid shut-off valve 48, respectively. The main suction pipe 49 is connected to the suction pipe 26 or the tank 23. In this regard, each of the auxiliary suction pipes 46 may be connected to the suction pipe 26 or connected to the tank 23, respectively.

FIG. 5 shows a case where the residents' homes are located along both sides of the sewage pipe and the drain pits 41 are also provided to both sides of the sewage pipe, so that two main suction pipes 49 are required to be provided. However, in a case where the residents' homes are located along only one side of the sewage pipe, only one main suction pipe 49 is provided. Accordingly, as a matter off course, the two main suction pipes 49 may be collected to form one suction pipe.

Figure 6:
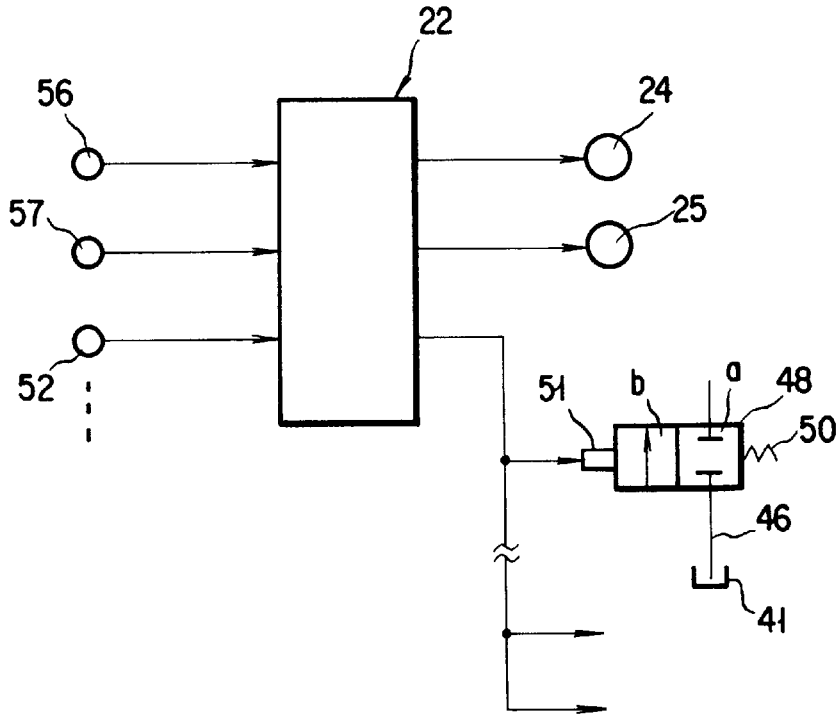

As shown in FIG. 6, each of the solenoid shut-off valves 48 takes a closed position a by the action of a spring 50 while takes an opened position b when a solenoid thereof is energized arid excited. The respective solenoids 51 are electrically controlled by the controller 22.

For example, as shown in FIG. 4, a level sensor 52 such as float switch or the like for outputting a signal when the sewage level in the drain pit 41 reaches to a constant value is provided to the respective auxiliary suction pipes 46 and the signal from the level sensor 52 is inputted to the controller 22.

The controller 22 energizes the respective solenoids 51 of the solenoid shut-off valves 48 in turn at a predetermined time intervals, so that one of the solenoid shut-off valves 48 takes an opened position b in turn for a predetermined period of time. Further, when the signal from the level sensor 52 is inputted to the controller 22, the solenoid 51 Of the solenoid shut-off valve 48 provided to the auxiliary suction pipe 46 connected to the drain pit 41 corresponding to the level sensor 52 is preferentially energized.

According to this structure, the sewage is sucked from any one of the plurality of the drain pits 41, so that a sucking power can be reduced in comparison with a case where the sewage in the respective drain pits 41 is simultaneously sucked, whereby the size of the vacuum suction pump 24 can be reduced.

By the way, the apparatus can be also constructed in such a manner that the level sensor 52 is not provided and the solenoids 51 of the solenoid shut-off valves 48 are energized in turn at a predetermined time intervals so that one of the solenoid shut-off valves 48 takes an opened position b in turn for a predetermined period of time.

Figure 7:
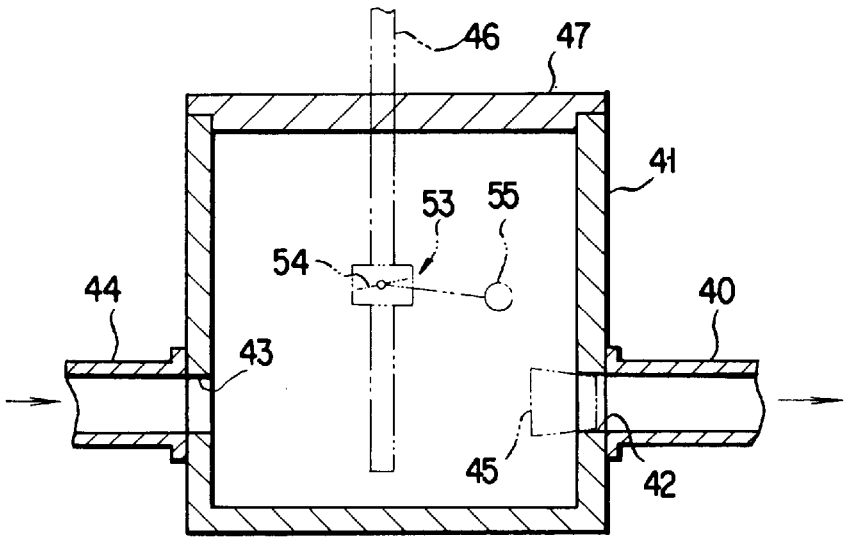

Further, as shown in FIG. 7, the apparatus can be also constructed so that a float valve 53 is provided to a top end portion of the auxiliary suction pipe 46 whereby the float valve 53 is opened when the sewage level in the drain pit 41 becomes to a predetermined level or more, while the float valve 53 is closed when the sewage level becomes lower than a predetermined height.

The float valve 53 is assembled so that a valve 54 is opened or closed by the action of a float 55. According to the structure described above, the solenoid shut-off valve 48 is not required.

When a starting signal from a start switch 56 is inputted to the controller 22, the controller 22 drives a vacuum suction pump 24 and a delivery pump 25, while when a stopping signal from a stop switch 57 is inputted to the controller 22, the controller 22 stops the operation of the vacuum suction pump 24 and the delivery pump 25.

Figure 8:
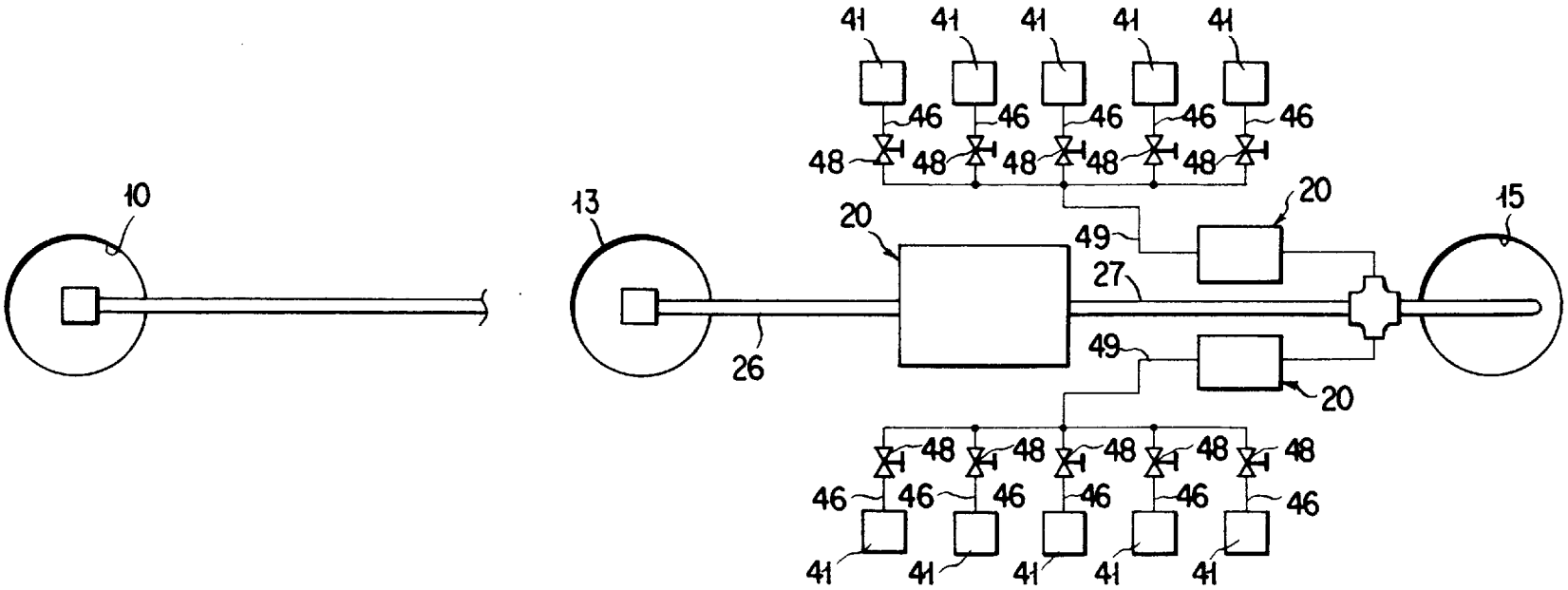

FIG. 8 shows a second embodiment of an apparatus for discharging the sewage in the drain pit 41. An exclusive suction discharging equipment 20 for exclusively sucking the sewages in the drain pits 41 is provided so as to discharge the sewage into a drain pipe 27. In a case shown in FIG. 8, the suction discharging equipment 20 is provided to both sides of the sewage pipe. However, only one suction discharging equipment can be also commonly used.

According to the structure described above, the sucking and discharging of the sewage from the sewage pipe and the sucking and discharging of the sewage from the drain pit 41 are performed by each of the suction discharging equipments, thus discharging a large amount of sewage or the like.

In this case, the sewage can be also directly discharged into a manhole at a portion of downstream side from the third manhole 15 by using the exclusive suction discharging equipment 20.

As shown in FIG. 1, a submerged pump, for example, a submerged grinder pump 60 is provided in the first manhole 10, and a delivery pipe of this pump 60 is connected to the drain pipe 27. Accordingly, the sewage or the like flowing out from the first sew-age pipe 11 are delivered to the discharging pipe 27, so that the sewage or the like would not so much flow into the second sewage pipe 12. Therefore, the vacuum suction pump 24 having a small size becomes usable.

That is, the sewage or the like flowing out from the drain pits of the respective homes flows into the second sewage pipe 12 through the drain pipe 40 and is then sucked by the suction pipe 26 and discharged.

By the way, a screen 62 is provided to an inlet side of the second sewage pipe 12.

Figure 9:
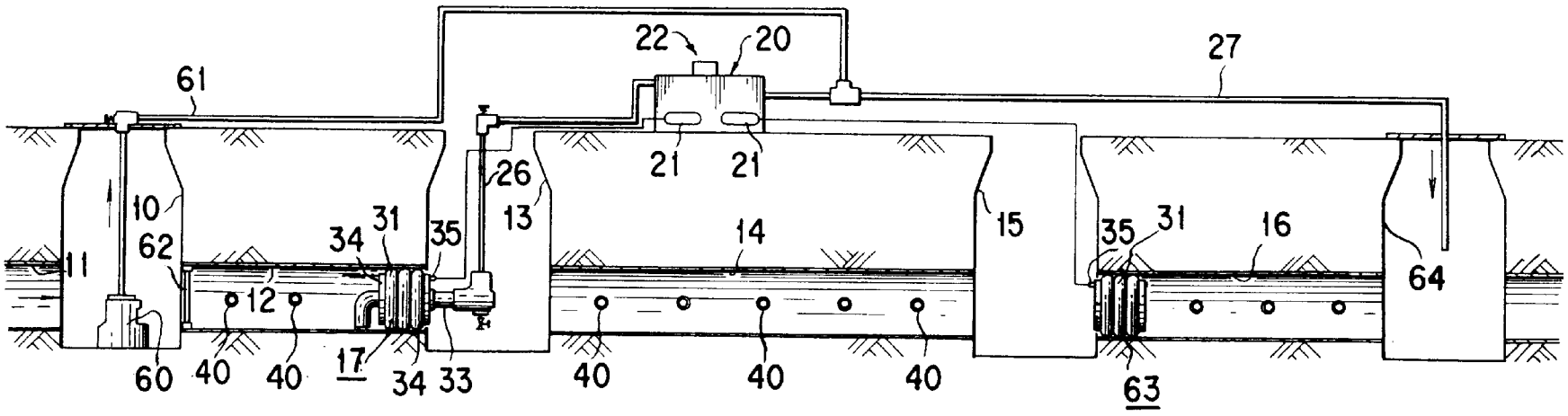

In addition, as shown in FIG. 9, the apparatus may also be constructed so that a stop cock 63 having no pipe inserted into the hollow portion for discharging the sewage is provided to a side portion of the third manhole to which the fourth sewage pipe 16 is opened, the side portion being a portion of the sewage pipe 16 into which the sewage flows. Due to this structure, the sewage or the like from the fourth sewage pipe 16 in the downstream side would not flow backward so as to flow into the third sewage pipe 14 as the working area. Further, a discharging pipe 27 is provided to the fourth manhole 64 which is a downstream side from the stop cock 63.

According to this structure, the structure of the stop cock 63 can be simplified and it becomes easy to manufacture the stop cock 63.

Though not shown, also similarly in an upstream side inlet port, the apparatus may be constructed so that a stop cock having no pipe inserted into the hollow portion for discharging the sewage is, located to a downstream side portion from the pipe for sucking the sewage of the upstream side.

Hereunder, an explanation will be started with respect to a second embodiment of the controller for opening or closing the shut-off valves 48, for example, the solenoid shut-off valve 48.

Figure 10:
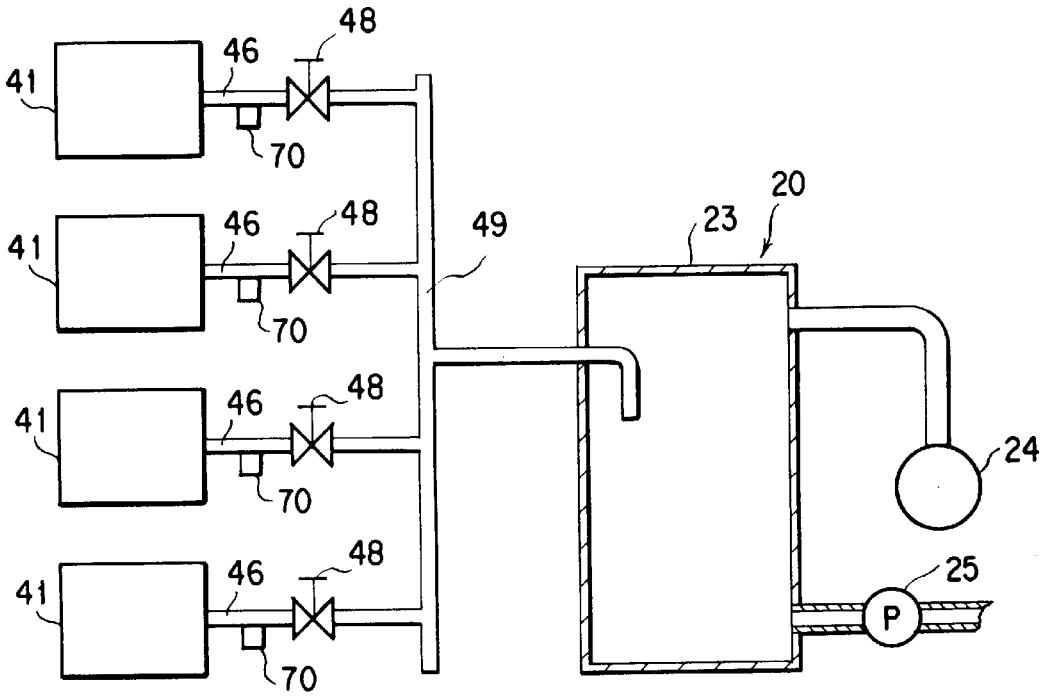

As shown in FIG. 10, the solenoid shut-off valve 48 is provided to each auxiliary suction pipe 46 for sucking the sewage in each drain pit 41, each of the auxiliary suction pipes 46 is connected to the main suction pipe 49, and the main suction pipe 49 is connected to an inside of a tank 23 of the suction discharging equipment 20.

Figure 11:
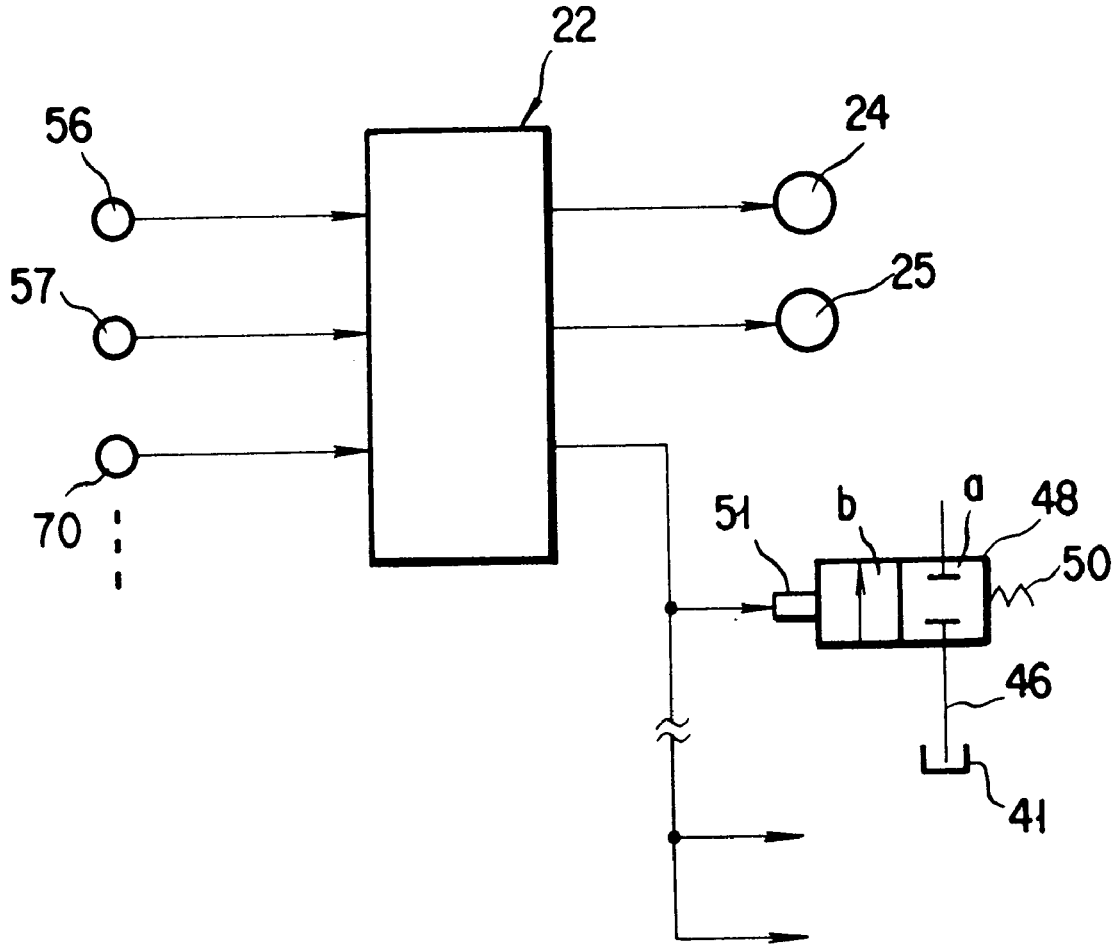

A sensor 70 for measuring a decree of vacuum is provided to a portion of each auxiliary suction pipe 46, the portion being close to the drain pit 41 from the solenoid shut-off valve 48. As shown in FIG. 11, values measured by each of the sensors 70 are inputted into the controller 22.

When a starting signal from a start switch 56 is inputted to the controller 22, the controller 22 drives a vacuum suction pump 24 and a delivery pump 25, so that an inside of the tank 23 is formed to be vacuum. For example, the degree of vacuum is set to about 60 mmHg to 0 mmHg. Simultaneously, the controller 22 energizes a solenoid 51 of one of the solenoid shut-off valves 48 so that the valve 48 takes an opened position b.

According to this operation, the sewage in one of the drain pit 41 is sucked into the tank 23 through the auxiliary suction pipe 46 and the main suction pipe 49, then the sewage is discharged by the delivery pump 25.

When the sewage amount in one of the drain pits 41 is decreased and one of the auxiliary suction pipe 46 sucks air, a degree of vacuum in the outstanding auxiliary suction pipe 46 becomes lower than that of tank 23. The degree of vacuum in the auxiliary suction pipe 46 is measured by the sensor 70 and inputted to the controller 22.

When the degree of vacuum measured by the sensor 70 becomes lower than a setting value, for example, 50 mmHg or less, the controller 22 stops energizing the solenoid 51 so that the corresponding solenoid shut-off valve 48 takes a closed position a. Simultaneously, the controller 22 energizes a solenoid 51 of one of the other solenoid valves 48 so that the corresponding solenoid shut-off valve 48 takes an opened position b, whereby the sewage in one of the other drain pit 41 is discharged in the same manner as described above.

When the sewage amount in one of the other drain pit 41 is decreased and the degree of vacuum detected by the sensor 70 becomes lower than the setting value, the controller 22 stops energizing the solenoid 51 of the solenoid shut-off valve 48 so that the valve 48 takes a closed position a. Then, a solenoid 51 of subsequent one of the other solenoid shut-off valve 48 is energized so that the valve 48 takes an opened position b, whereby the sewage in the subsequent one of the other drain pit 41 is discharged. By repeating the sequential operations described above in turn, the sewages in all of the drain pits 41 are discharged.

As a result, the sewage in a plurality of the drain pits 41 can be discharged at every drain pit, so that the vacuum suction pump 24 can be constructed in a small size. Further, the auxiliary suction pipe 46 is provided with the sensor 70, so that it is sufficient to connect the auxiliary suction pipe 46 to the drain pit 41, thus simplifying the operation thereof.

Further, the sensor 70 is provided to the auxiliary suction pipe 46 at a portion close to the drain pit 41 and apart from the solenoid shut-off valve 48, so that when the solenoid shut-off valve 48 takes a closed position a, the degree of vacuum measured by the sensor 70 will become to an atmospheric pressure (760 mmHg), whereby the solenoid shut-off valve 48 would not malfunction.

In addition, a distance from the sensor 70 to the drain pit 41 is short while a distance from the sensor 70 to the tank 23 is long. Therefore, when the amount of the sewage in the drain pit 41 is decreased and the auxiliary suction pipe 46 sucks air, and accordingly, a value measured by the sensor 70 becomes lower than a setting value, the sewage exists at a portion of the auxiliary suction pipe 46 close to the main suction pipe 49 and the main suction pipe 49, so that the degree of vacuum in the tank 23 would not be lowered. In addition, when the value measured by the sensor 70 becomes lower than a setting value, the solenoid shut-off valve 48 promptly takes a closed position a.

As described above, there is no case of lowering the vacuum degree in the tank 23, so that the sewage in the respective drain pits 41 can be effectively discharged.

As indicated by a solid line in FIG. 12, the sensor 70 may be disposed to a portion of each auxiliary suction pipes 46, respectively, the portion being closer to tank 23 from the solenoid shut-off valve 48. Further, as indicated by a virtual line in FIG. 12, one sensor 70 may be commonly located to a portion of the main suction pipes 49. Furthermore, one sensor 70 may be located to the tank 23.

In this case, when the degree of vacuum measured by the sensor 70 becomes lower than a setting value, the controller stops energizing the solenoid 51 of one of the solenoid shut-off valves 48 so that the valve 48 takes a closed position a. Then, after the degree of vacuum measured by the sensor 70 returns to a predetermined value, the solenoid of one of the other solenoid shut-off valves 48 is energized so as to take an opened position b.

That is, in a case where the sensor 70 is provided for a portion closer to the tank 23 from one of the solenoid shut-off valve 48, the solenoid shut-off valve 48 takes an opened position b and the sewage in one of the drain pit 41 is discharged, and in this state, when the suction pipe sucks air to thereby lowering the degree of vacuum measured by the sensor, the degrees of vacuum in the other auxiliary suction pipes 46, the main suction pipe 49 and the tank 23 are lowered. Accordingly, one of the other solenoid shut-off valves 48 takes the closed position a. Then, after the degree of vacuum measured by the sensor 70 returns to a predetermined value, the solenoid 51 of one of the other solenoid shut-off valves 48 is energized so as to take an opened position b.

The control for opening or closing the shut-off valve, for example, the solenoid valve 48 can be also performed by using the sensor 70 for measuring the degree of vacuum described above and a level sensor 52 for outputting a signal when a sewage level in the drain pit 41 shown in FIG. 4 reaches a constant height.

More concretely, as shown in FIG. 13, the degree of vacuum measured by the sensor 70 is inputted to the controller 22 as well as the signal from the level sensor 52 is inputted to the controller.

Furthermore, in a case where a signal from the level sensor 52 is not inputted to the controller 22, in the same manner as described above, one of the solenoid shut-off valves 48 is opened in a predetermined order while the remaining solenoid shut-off valves 48 are closed, whereby the sewage in one drain pit is discharged through one auxiliary suction pipe. When the degree of vacuum measured by the sensor 70 becomes lower than a setting value, the solenoid shut-off valve is closed, while one of the remaining shut-off valves is opened in a predetermined order, whereby the sewage in one of the remaining drain pits 41 is discharged in turn.

In addition, in a case where the sewage in one drain pit 41 is discharged in a predetermined order as described above, when a signal from the level sensor 52 is inputted to the controller 22, the controller 22 controls the respective solenoid shut-off valves 48 in such a manner that the current conduction to a solenoid 51 now in an energized state is stopped, whereby the corresponding solenoid shut-off valve 43 takes a closed position a.

At the same time, the controller 22 energizes the solenoid 51 of the solenoid shut-off valve 48 disposed to the auxiliary suction pipe 46 connected to the drain pit 41 corresponding to the Level sensor 52 which outputs the signal to the controller 22, so that the valve 48 takes an opened position b whereby the sewage in the drain pit 41 described above is discharged.

When the degree of vacuum measured by the sensor 70 provided to the auxiliary suction pipe 46 of the drain pit 41 in charge of discharging the sewage becomes lower than the setting value, the current conduction to the solenoid 51 is stopped so that the solenoid shut-off valve 48 takes a closed position a. Then, in accordance with the order set in the opening-closing operation by the sensor 710, a solenoid 51 of a subsequent solenoid shut-off valve 48 next to the solenoid shut-off valve 48 taking a closed position a is energized so that the outstanding valve 48 takes an opened position b.

As described above, when the signal from the level sensor 52 is inputted to the controller, the sewage in the drain pit 41 provided with the level sensor 52 is preferentially discharged prior to the sewage in the drain pit taking charge of discharging the sewage in a predetermined order, the sewage in the drain pit 41 would not overflow.

In addition, the sewage in one drain pit 41 among a plurality of the drain pits 41 can be also discharged by combining the following operations: i.e., an operation for energizing the respective solenoids 51 of the shut-off valves 48, for example, the solenoid shut-off valves 48 in turn in a predetermined order; an operation for stopping the energizing of this solenoid 51 and for energizing the solenoid 51 of the subsequent solenoid shut-off valve 48 when the degree of vacuum measured by the sensor 70 becomes lower than the setting value or the degree of vacuum measured by the sensor 70 would not become lower than the setting value even after a predetermined time has passed; and an operation for energizing the solenoid 51 by means of the level sensor 52 for outputting the signal when the sewage level in the drain pit 41 reaches a constant height.

For example, the controller 22 shown in FIG. 13 is constructed so as to have the following three functions: i.e., a first function of energizing the solenoids 51 of a plurality of the solenoid shut-off valves 48 in a predetermined order which is previously set; a second function of energizing the solenoid 51 on the basis of the degree of vacuum measured by the sensor 70; and a third function of energizing the solenoid 51 on the basis of a signal from a sensor, for example, the level sensor 52 shown in FIG. 4.

The second function described above will be explained more concretely. In a case where the solenoids 51 are energized in a predetermined order so that the corresponding solenoid shut-off valve 48 takes an opened position b in turn and the sewage in one drain pit 41 is discharged, when the degree of vacuum measured by the sensor 70 corresponding to the drain pit 41 becomes lower than the setting value or the degree of vacuum measured by the sensor 70 would not become lower than the setting value even after a predetermined time has passed, the solenoid 51 is immediately stopped being energized and another solenoid 51 of a subsequent solenoid shut-off valve 48 is energized.

Above sequential operation can be expressed by a flowchart as shown in FIG. 14.

The third function described above will be explained more concretely.

As described above, in a case where the sewage in one drain pit 41 is discharged in ai predetermined order, when the signal from the level sensor 52 is inputted to the controller 22, the controller 22 controls the respective shut-off valves in such a manner that the current conduction to the solenoid 51 now in an energized state at that time is stopped so that the solenoid shut-off valve 48 takes a closed position a.

At the same time, the controller 22 energizes the solenoid 51 of the solenoid shut-off valve 48 provided to the auxiliary suction pipe 16 connected to the drain pit 41 corresponding to the level sensor 52 which outputs the signal to the controller 22, so that the valve 48 takes an opened position b whereby the sewage in the drain pit 41 is discharged.

When the degree of vacuum measured by the sensor 70 disposed to the auxiliary suction pipe 46 of the drain pit 41 taking charge of discharging the sewage becomes lower than the setting value, the current conduction to the solenoid 51 is stopped so that the solenoid shut-off valve 48 takes a closed position a. Then, in accordance with the order set in the opening-closing operation by the sensor 70, the solenoid 51 of a subsequent solenoid shut-off valve 48 next to the solenoid shut-off valve 48 taking a closed position a is energized so that the outstanding valve 48 takes an opened position b.

Although the present invention has been described with reference to the exemplified embodiments, it will be apparent to those skilled in the art that various modifications, changes, omissions, additions and other variations can be made in the disclosed embodiments of the present invention without departing from the scope or spirit of the present invention. Accordingly, it should be understood that the present invention is not limited to the described embodiments, and shall include the scope specified by the elements defined in the appended claims and range of equivalency of the claims.

We claim:

1. A sewage by-pass discharging apparatus for sewage pipe works, comprising: an upstream side stop cock disposed at an upstream side of a sewage pipe laid in a working area; a downstream side stop cock disposed at a downstream side of the sewage pipe laid in the working area; means for discharging the sewage accumulated at an upstream side from the upstream side stop cock to a downstream side from downstream side of the downstream side stop cock by bypassing the sewage pipe; a drain pipe connected to the sewage pipe laid in the working area; a drain pit connected to the drain pipe; a stop cock for preventing the sewage from flowing from the drain pit into the drain pipe; and means for discharging the sewage reserved in the drain pit to the downstream side from the downstream side stop cock.

2. A sewage by-pass discharging apparatus for sewage pipe works according to claim 1, wherein both said upstream and downstream side stop cocks expansively deform by being supplied with air so that an outer periphery portion of each of the stop cocks is press contacted to an inner periphery surface of said sewage pipe, and each of said stop cocks is provided with a pipe penetrating through said stop cock.

3. A sewage by-pass discharging apparatus for sewage pipe works according to claim 1 or 2, wherein each of a plurality of drain pits is provided with an auxiliary suction pipe so as to be inserted into said drain pit, respectively, and each of said auxiliary suction pipes is connected to a main suction pipe which is connected to a suction side of a suction discharge equipment, so that the sewage in the respective drain pits is discharged to the downstream side from said downstream side stop cock.

4. A sewage by-pass discharging apparatus for sewage pipe works according to claim 1 or 2, wherein each of a plurality of drain pits is provided with an auxiliary suction pipe so as to be inserted into the drain pit, respectively, and each of said auxiliary suction pipes is connected to a suction side of a suction discharge equipment, so that the sewage in the respective drain pits is discharged to the downstream side from said downstream side stop cock.

5. A sewage by-pass discharging apparatus for sewage pipe works according to claim 3, further comprising means for controlling the respective auxiliary suction pipes so as not to simultaneously suck the sewage.

6. A sewage by-pass discharging apparatus for sewage pipe works according to claim 5, wherein each of said auxiliary suction pipes is provided with a shut-off valve, said shut-off valves taking an opened position in turn at predetermined intervals of time whereby each of said auxiliary suction pipes sucks the sewage in turn for a predetermined time.

7. A sewage by-pass discharging apparatus for sewage pipe works according to claim 6, wherein each of said drain pits is provided with a level sensor for sensing a level of the sewage so as to output a signal when the sewage level reaches to a predetermined level, and the shut-off valve provided to the auxiliary suction pipe inserted into the corresponding drain pit having the level sensor preferentially takes an opened position when the level sensor outputs the signal.

8. A sewage by-pass discharging apparatus for sewage pipe works according to claim 5, wherein said auxiliary suction pipe is provided with a float valve which takes an opened position when the level of the sewage in said drain pit becomes higher than a predetermined level while takes a closed position when the level of the sewage in the drain pit becomes lower than a predetermined level.

9. A sewage by-pass discharging apparatus for sewage pipe works according to claim 5, further comprising a shut-off valve provided to each of the auxiliary suction pipes, respectively, a controller for controlling the respective shut-off valves so as to take the opened or closed position, and a sensor for sensing a degree of vacuum of a portion closer to the drain pit from the shut-off valve so as to input the degree of vacuum to the controller, wherein said controller controls the shut-off valves in such a manner that one of shut-off valves is opened while remaining shut-off valves are closed so as to discharge the sewage in one drain pit through one auxiliary suction pipe and when the degree of vacuum of the one auxiliary suction pipe becomes lower than a setting value, the one shut-off valve is closed while one of the other remaining shut-off valves is opened in a predetermined order.

10. A sewage by-pass discharging apparatus for sewage pipe works according to claim 5, further comprising a shut-off valve provided to each of said auxiliary suction pipes, respectively, a controller for controlling the respective shut-off valves so as to take an opened or closed position, and a sensor for measuring a degree of vacuum of a portion between the respective drain pit and the suction discharging equipment so as to input the degree of vacuum to the controller, wherein said controller controls the shut-off valves in such a manner that one of shut-off valves is opened while the remaining shut-off valves are closed so as to discharge the sewage in one drain pit through one auxiliary suction pipe and when the degree of vacuum detected by the sensor becomes lower than a setting value, the one shut-off valve is closed while one of the other remaining shut-off valves is opened in a predetermined order.

11. A sewage by-pass discharging apparatus for sewage pipe works according to claim 10, wherein said controller controls the shut-off valves in such a manner that one of the shut-off valves is opened while the remaining shut-off valves are closed so as to discharge the sewage in one drain pit through one auxiliary suction pipe, and when the degree of vacuum detected by the sensor becomes lower than a setting value, the one shut-off valve is closed, and when the degree of vacuum detected by the sensor is returned to the setting value, one of the other remaining shut-off valves is opened.

12. A sewage by-pass discharging apparatus for sewage pipe works according to claim 5, further comprising a shut-off valve provided to each of said auxiliary suction pipes, respectively, a controller for controlling the respective shut-off valves so as to take an opened or closed position, a sensor for measuring a degree of vacuum of a portion between a suction opening of the respective auxiliary suction pipes disposed to the drain pits and the suction discharging equipment, and a level sensor for sensing a level of the sewage in the drain pit to input a signal into the controller when the level reaches to a predetermined level, wherein said controller controls the shut-off valves in such a manner that when the signal from the level sensor is not inputted, one of the shut-off valves is opened in a predetermined order while the remaining shut-off valves are closed so as to discharge the sewage in one drain pit through one auxiliary suction pipe and when the degree of vacuum detected by the sensor becomes lower than a setting value, the one shut-off valve is closed while one of the other remaining shut-off valves is opened in a predetermined order, and wherein said controller controls the shut-off valves in such a manner that when the signal from the level sensor is inputted, the shut-off valve in an opened state at that time is closed while the shut-off valve provided to the auxiliary suction pipe connected to the drain pit having the level sensor is opened and when the degree of vacuum detected by the sensor becomes lower than a setting value, the one shut-off valve is closed while one of the other remaining shut-off valves is opened in a predetermined order.

13. A sewage by-pass discharging apparatus for sewage pipe works according to claim 5, further comprising a shut-off valve provided to each of said auxiliary suction pipes, respectively, a controller for controlling the respective shut-off valves so as to take an opened or closed position, a sensor for measuring a degree of vacuum of a portion between of the respective shut-off valves and the suction discharging equipment, and a level sensor for measuring a level of the sewage in the drain pit to input a signal into the controller when the level reaches to a predetermined level, wherein the controller has: a first function of controlling the shut-off valves in such a manner that when the degree of vacuum measured by the sensor becomes lower than a predetermined value, the one shut-off valve is closed while one of the other remaining shut-off valves is opened in a predetermined order, a second function of controlling the shut-off valves in such a manner that when a sucking time exceeds a predetermined time in a while the degree of vacuum would not become lower than a predetermined value, the one shut-off valve is closed while one of the other remaining shut-off valves is opened in a predetermined order, and a third function of preferentially controlling the shut-off valves regardless of the first and second functions in such a manner that when the signal from the level sensor is inputted into the controller, the shut-off valve in an opened state at that time is closed while the shut-off valve provided to the auxiliary suction pipe connected to the drain pit having the level sensor is opened and when the degree of vacuum detected by the sensor becomes lower than a setting value, or when a sucking time exceeds a predetermined time in a while the degree of vacuum would not become lower than a setting value, the one shut-off valve is closed while one of the other remaining shut-off valves is opened in turn.

* * * * *